US006151905A

United States Patent [19]

Smith

[11] Patent Number: 6,151,905

[45] Date of Patent: Nov. 28, 2000

[54] FOOD PREPARATION TABLE

[75] Inventor: Al Smith, Holt, Mo.

[73] Assignee: Premark FEG L.L.C., Wilmington, Del.

[21] Appl. No.: 09/318,226

[22] Filed: May 25, 1999

Related U.S. Application Data

[60] Provisional application No. 60/086,905, May 27, 1998.

[51] Int. Cl.[7] ..... F25D 17/08

[52] U.S. Cl. ..... 62/258; 62/426

[58] Field of Search ..... 62/258, 407, 408, 62/419, 426

[56] References Cited

U.S. PATENT DOCUMENTS

| | | | |
|---|---|---|---|
| 2,660,864 | 12/1953 | Morris | 62/89.5 |
| 2,886,395 | 5/1959 | Cahn | 62/258 |
| 3,056,274 | 10/1962 | Pouchert | 62/418 |
| 3,123,988 | 3/1964 | Richman | 62/418 |
| 3,196,632 | 7/1965 | Buffington | 62/281 |
| 3,232,072 | 2/1966 | Barroero | 62/256 |
| 3,299,664 | 1/1967 | Booth | 62/419 |
| 4,407,143 | 10/1983 | Wolfe | 62/303 |
| 4,408,465 | 10/1983 | Ibrahim | 62/82 |
| 4,457,140 | 7/1984 | Rastelli | 62/261 |
| 4,592,209 | 6/1986 | Casanova et al. | 62/255 |
| 4,603,557 | 8/1986 | Halbmann | 62/255 |
| 4,628,697 | 12/1986 | Bruck et al. | 62/89 |
| 4,685,311 | 8/1987 | Rastelli | 62/258 |
| 4,989,419 | 2/1991 | Brando et al. | 62/457.2 |
| 5,007,249 | 4/1991 | Van Druff, Jr. | 62/255 |
| 5,168,719 | 12/1992 | Branz et al. | 62/258 |
| 5,182,923 | 2/1993 | Trulaske, Sr. | 62/249 |
| 5,182,924 | 2/1993 | Trulaske, Sr. | 62/255 |
| 5,191,769 | 3/1993 | Mangini et al. | 62/258 |
| 5,247,807 | 9/1993 | Jarman et al. | 62/227 |
| 5,282,367 | 2/1994 | Moore et al. | 62/256 |
| 5,363,672 | 11/1994 | Moore et al. | 62/258 |
| 5,381,672 | 1/1995 | Haasis | 62/419 |
| 5,423,194 | 6/1995 | Senecal | 62/457.6 |
| 5,442,932 | 8/1995 | O'Hearne | 62/255 |
| 5,461,878 | 10/1995 | Moore et al. | 62/255 |
| 5,477,702 | 12/1995 | Kennedy et al. | 62/258 |

*Primary Examiner*—William E. Tapolcai
*Attorney, Agent, or Firm*—Thompson Hine & Flory LLP

[57] ABSTRACT

The invention provides a food preparation table which has improved cooling characteristics over prior art preparation tables, is efficient, and can be used with existing food storage pans. More particularly, the invention provides a food preparation table for holding ingredient/condiment storage pans that are open to access by food preparation personnel and which has cooling vents that are precisely positioned and shaped so that the condiments/ingredients in the pans are kept at a desired temperature, especially near the tops of the pans, and which does not prematurely dry the ingredients.

21 Claims, 4 Drawing Sheets

FOOD PREPARATION TABLE

CROSS REFERENCE TO RELATED APPLICATIONS

This application claims priority from provisional application U.S. Ser. No. 60/086,905 entitled "Food Preparation Table," filed on May 27, 1998.

BACKGROUND OF THE INVENTION

This invention relates to refrigerated tables for use in the preparation of food that are constructed with areas for holding ingredient storage pans or bins that are open to the air and easily accessible to food preparation personnel. The invention also relates to refrigerated tables that are equipped with work areas in close proximity to the refrigerated storage pans to provide the food preparation personnel spaces to prepare the food. These tables are generally used in restaurants, cafeterias, or by food service providers for the preparation of sandwiches, salads, etc. More particularly, the present invention relates to a novel refrigeration configuration for refrigerating storage pans in such tables having improved cooling characteristics over prior art food preparation tables.

In the preparation of food, it is common that many of the ingredients require refrigeration to a certain temperature to comply with health regulations as well as to improve the shelf life of the ingredients and the taste of the finished product. While these lower temperatures can generally be easily achieved by storing the ingredient pans in a conventional closed refrigeration unit, access to the ingredients is hindered, thus increasing food preparation time. Prior art food preparation tables have attempted to solve this problem in many different ways. Systems utilizing storage pans that are cooled from the bottom have been used with reasonable success, except that the area near the top of the pan is generally not kept as cool as is desired and required by health regulations. For example, U.S. Pat. No. 5,191,769 to Mangini et al. discloses a food preparation table having a refrigerated ingredient zone wherein a flow directing baffle is used to direct air vertically and horizontally towards the bottom and the lower sides of the condiment/ingredient pans. However, the flow of refrigerated air disclosed by the Mangini et al. patent is not directed to the tops of the condiment/ingredient pans, resulting in the temperature of the condiments/ingredients being higher than desired near the tops of the pans.

Other systems have been developed which are better at keeping the tops of the pans close to the desired temperature. For example, U.S. Pat. No. 4,685,311 to Rastelli discloses a food preparation table which is equipped with vents both above and below the pans. The vents below the pans operate similarly to the vents disclosed in Mangini et al., while the vents above the pans blow refrigerated air down over the top of the pans. In this way a refrigerated zone of air is created both above and below the pans thereby keeping the ingredients/condiments at the top of the pans closer to the desired temperature than other prior art preparation tables. However, this set-up creates other problems. In particular, the refrigerated air that is blown over the tops of the pans has the effect of prematurely drying the ingredients which detrimentally effects the shelf life and taste of the food being prepared. Thus, the preparation table disclosed in the Rastelli patent does not provide optimal refrigeration performance either.

Accordingly, it would be desirable to have a food preparation table which resolves some of the above-identified problems associated with prior art food preparation tables. More specifically, it would be desirable to have a food preparation table which effectively cools food ingredients/condiments that are stored in open air storage pans without drying out the ingredients thereby detrimentally effecting shelf life or food taste. It is further desired to have such a table that is of simple design, is ergonomically and thermodynamically efficient, is inexpensive to manufacture, and can be used effectively in existing kitchen arrangements with existing storage pans.

SUMMARY OF THE INVENTION

In accordance with the present invention, a food preparation table is provided which has improved cooling characteristics over prior art preparation tables, is efficient, and can be used with existing storage pans. More particularly, the invention provides an apparatus for cooling food ingredients in storage pans which does not prematurely dry the ingredients and keeps the entire contents of the storage pans close to the desired temperature. The food preparation table of the present invention preferably includes a rectangular cabinet that is made of a suitable material such as stainless steel. The food preparation table preferably includes a refrigeration unit having a motor, fans, and a compressor, as well as other equipment as is well known in the refrigeration art, to provide cold air as needed to the table. In a preferred embodiment the refrigeration unit is provided with two fans (one fan per inlet duct) each of which is capable of moving 200 cubic feet of air per minute. Also in a preferred embodiment, the refrigeration unit can produce over 3000 BTU's an hour, and most preferably 3480 BTU's an hour. Of course, these specifications are those of a preferred embodiment and may be modified as necessary depending on the design constraints of any particular food preparation table application.

While the food preparation table of the present invention is not limited to any particular dimensions or shapes, for most applications the food preparation table has a rectangular top. The top of the food preparation table is preferably divided into two general areas, namely a work area and a refrigerated pan opening. The refrigerated pan opening is shaped to receive a number of ingredient/condiment pans and may optionally include a hood or removable top to cover or protect the ingredients that are stored in the pans. The refrigerated pan opening is preferably provided with ledges to receive corresponding support edges on the ingredient/condiment pans such that when the pans are placed in the refrigerated pan opening, the pans are suspended in the table such that most of the pan depth is maintained in a refrigerated pan zone underneath the refrigerated pan opening. Additionally, in a preferred embodiment the refrigerated pan opening is recessed in the top of the cabinet to help prevent the flow of ambient air over the tops of the ingredient/condiment storage pans.

Preferably, as mentioned above, a work area is provided in close proximity to the refrigerated pan zone, and the entire table comprises a cabinet having a general refrigerated area enclosed by doors underneath the refrigerated pan opening and the preparation area. The general refrigerated area is preferably divided into two sections, namely a refrigerated pan zone which is located directly underneath the refrigerated pan opening and a cold food storage area. The refrigerated pan zone is preferably defined by walls of a suitable material, such as stainless steel, and is deep enough to receive the ingredient/condiment pans without having them touch the bottom of the refrigerated pan zone. A length of ducts is provided in the cabinet which is in cold air communication with the refrigeration unit fans. Preferably the ducts run the length of the cabinet parallel to the length of the refrigerated pan zone. Accordingly, in a preferred embodiment, two channels (ducts) run along the sides of the refrigerated pan zone, each of which preferably is supplied with a cold air flow from a separate fan.

In accordance with the invention, a row of inlet vents is provided in the ducts running alongside the refrigerated pan zone for allowing cold air communication between the ducts and the refrigerated pan zone. The vents are provided near the top of the refrigerated pan zone close to the refrigerated pan opening in order to provide cold air communication from the ducts to the refrigerated pan zone. In order to insure adequate cooling at the top of the pans, the vents should be placed as close as possible to the top edge of the pan zone, preferably within 1.5 inches of the top edge.

A row of outlet vents is placed at the bottom of the refrigerated pan zone allowing circulated air to be drawn out of the refrigerated pan zone. Although the location of the outlet vents is not as critical as the location of the inlet vents, preferably they are located directly underneath the pans spaced equidistantly from either row of inlet vents, thereby allowing for a large amount of cold air circulation among the pans prior to the cold air exiting the refrigerated pan zone. In a preferred embodiment, the exit vents lead into a cold food storage area enclosed by the doors and the cabinet. The cool air then circulates through the cabinet cooling the contents therein until it is drawn out of a main bottom vent and back to the refrigeration unit where it is re-cooled and recirculated. The cold food storage area may optionally include shelves and is useful in storing the storage pans from the table when they are not being used in the preparation of food.

DETAILED DESCRIPTION

Figure 1:
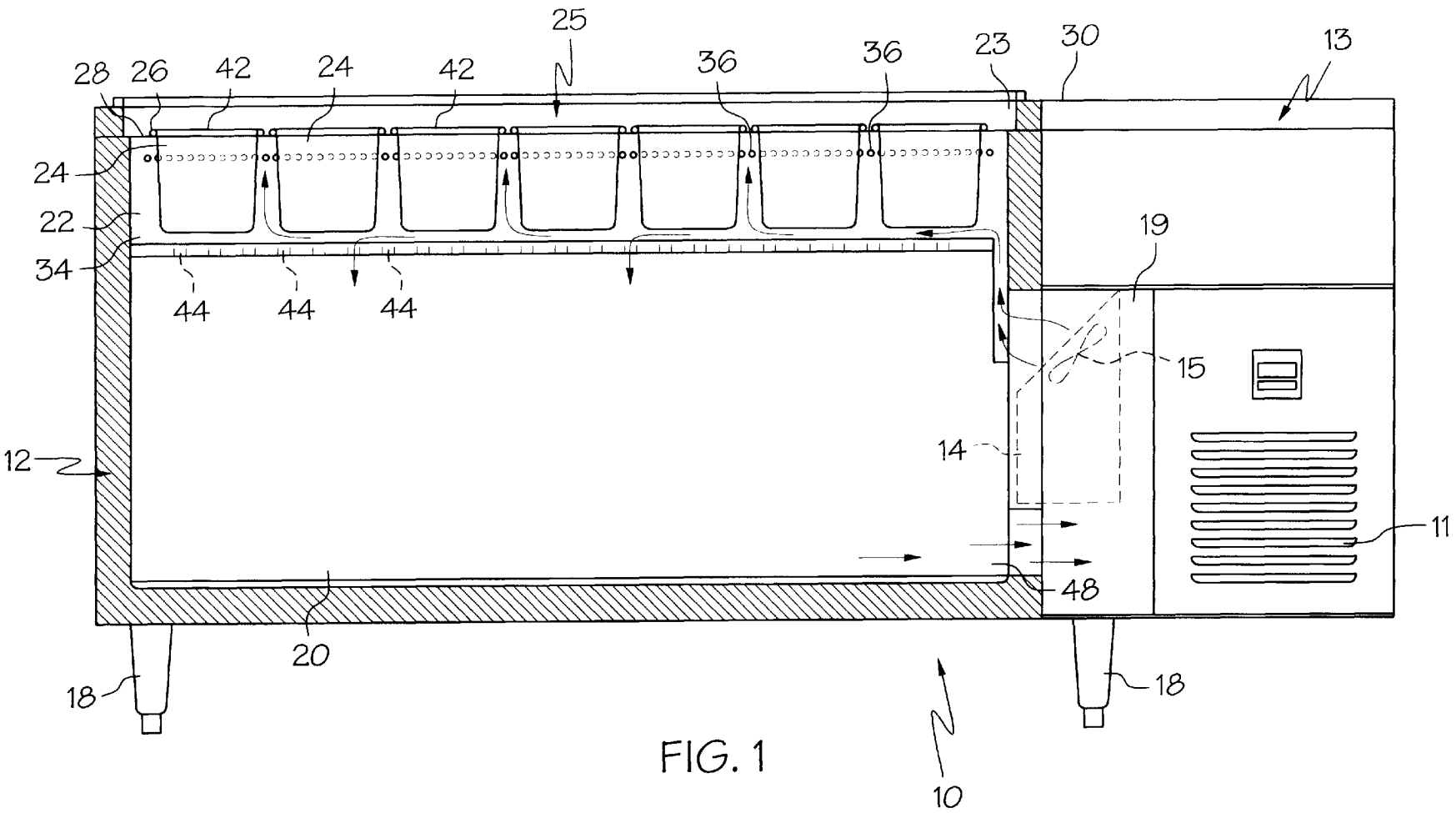
FIG. 1 is a front elevational view of a food preparation table in accordance with the present invention.

Referring to FIG. 1, the food preparation table generally designated 10 of the present invention includes a cabinet 12, having a top 13, doors 16, legs 18, and a refrigeration unit 14 with fans 15. In a preferred embodiment, the refrigeration unit 14 is located in an insulated compartment 19 in the cabinet 12 and includes an outlet vent (not shown) for exhausting heated air to the outside of the cabinet 12.

The cabinet 12 defines a cold food storage area 20 and a refrigerated pan zone 22 on the inside of the cabinet 12. A work area 30 and a refrigerated pan opening 25 are provided on the top 13 of the cabinet 12. The refrigerated pan opening 25 is shaped to receive several ingredient/condiment storage pans 24 so that most of each pan 24 is suspended in the refrigerated pan zone 22 in the cabinet 12. Also in a preferred embodiment, the refrigerated pan opening 25 is recessed into the top 13 of the cabinet 12 and is surrounded by a lip 23 so that ambient air is prevented from blowing directly across the ingredient/condiment storage pans 24. This is important because the flow of air over the pans 24 undesirably dries and spoils the ingredients/condiments stored therein. The pans 24 are provided with edges 26 which engage corresponding ledges 28 in the refrigerated pan opening 25 so that when each pan 24 is placed in the refrigerated pan opening 25 substantially all of the depth of the pans 24 are suspended in the refrigerated pan zone 22.

Figure 2:
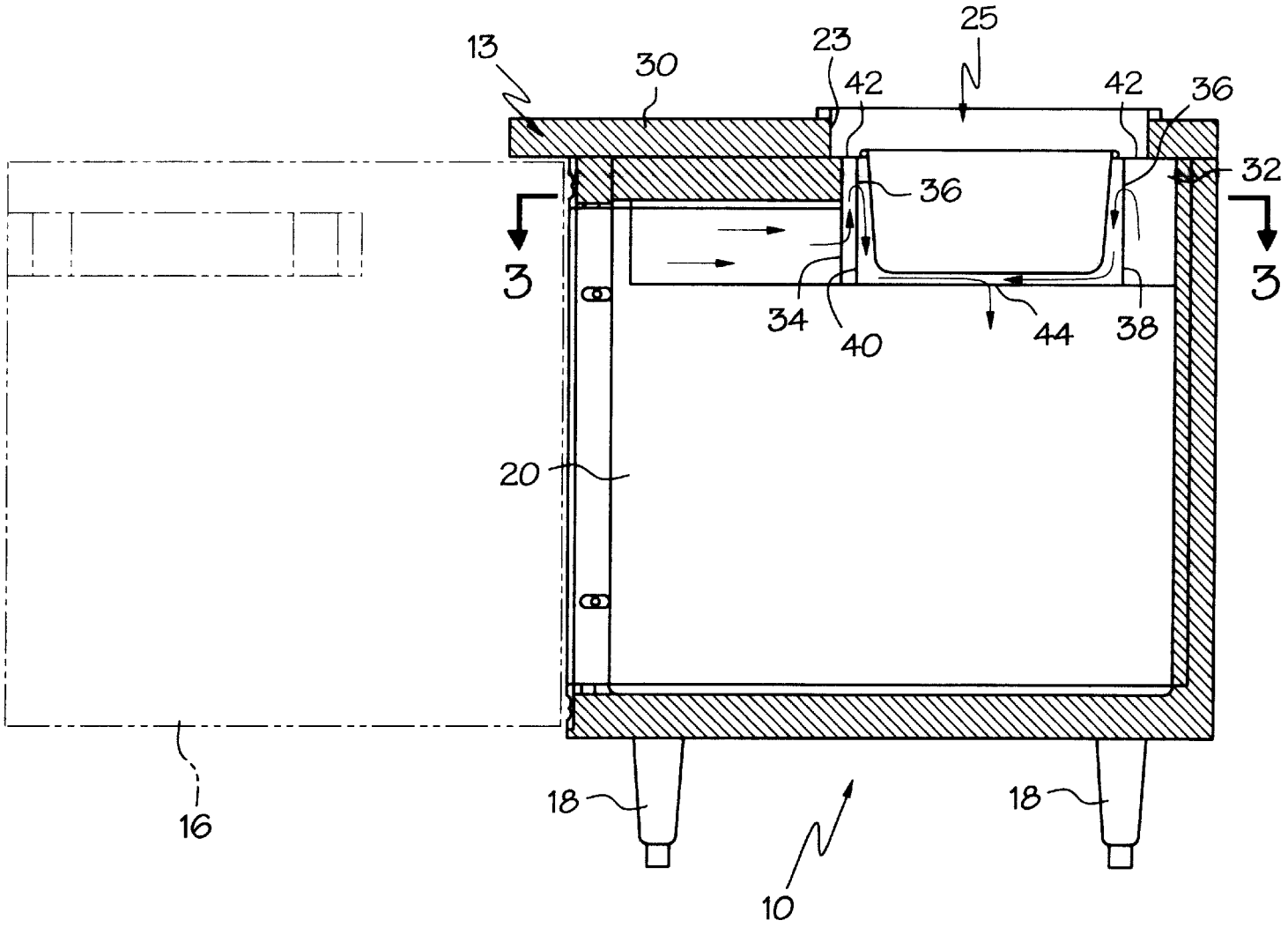
FIG. 2 is a side elevational view of the food preparation table of FIG. 1.
Figure 3:
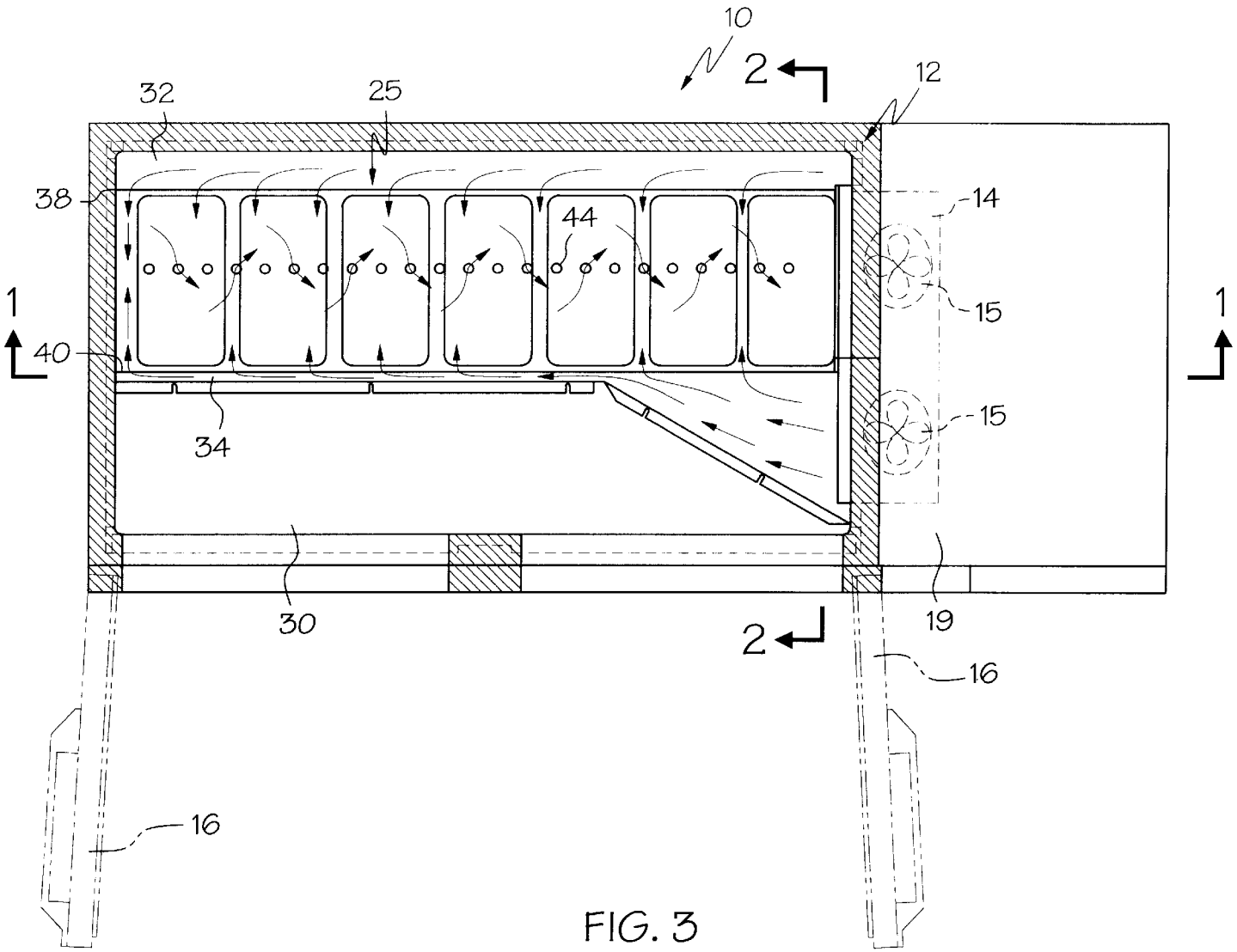
FIG. 3 is a top plan view of the food preparation table of FIG. 1.
Figure 4:
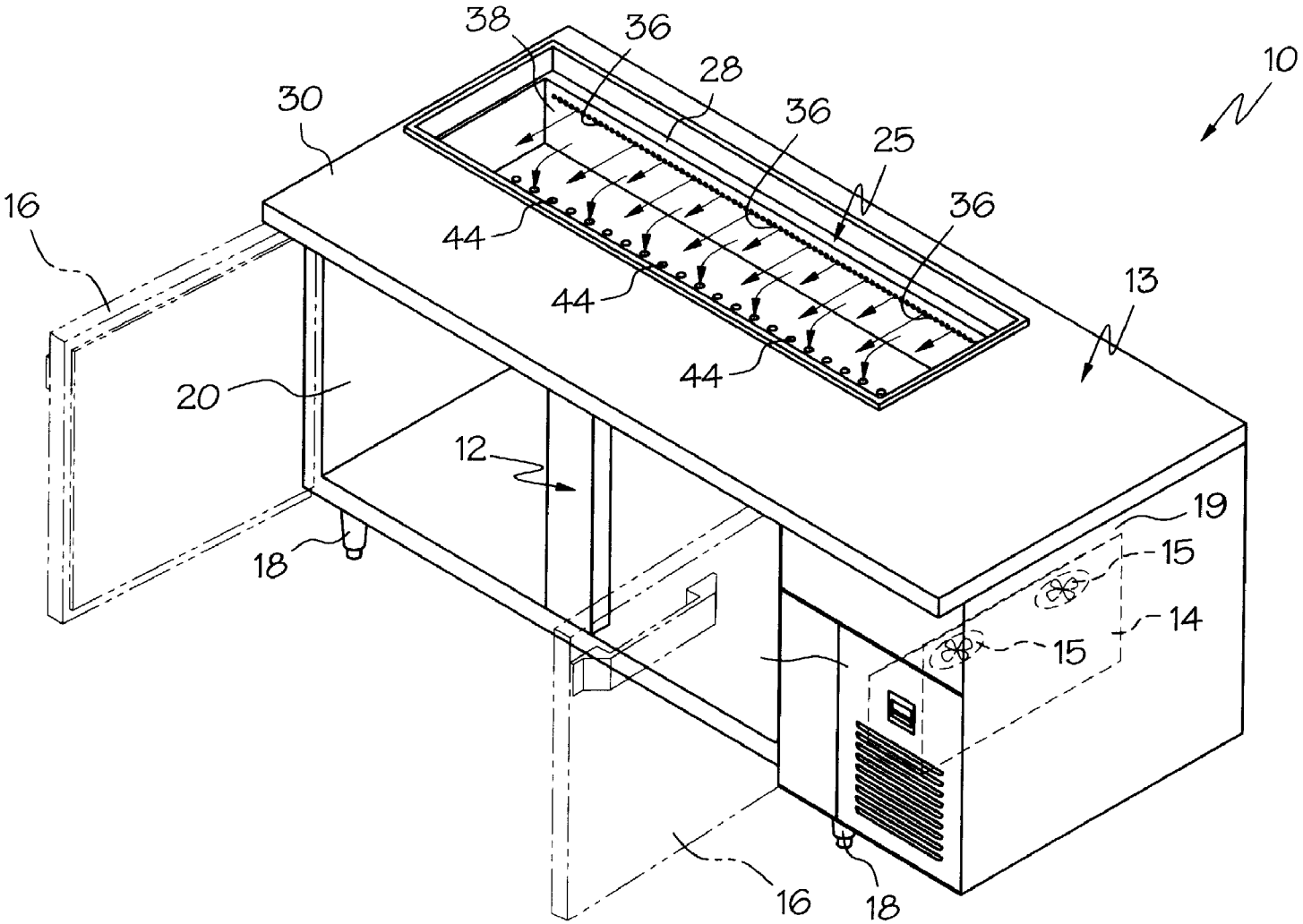
FIG. 4 is a perspective view of a refrigerated pan zone in the food preparation table of FIG. 1.

As best shown in FIGS. 2 and 3, work area 30 is located proximal to the refrigerated pan opening 25 on the top 13 of the cabinet 12. Ducts 32, 34 are provided inside the cabinet 12 which is in cold air communication with the refrigeration unit 14 and preferably runs the length of the cabinet 12 on both sides of the refrigerated pan zone 22. Inlet vents 36 are positioned in the side walls 38, 40 of the refrigerated pan zone 22 and provide cold air communication between the ducts 32, 34 and the refrigerated pan zone 22. The inlet vents 36 are preferably spaced 1.5 inches or less from the top 42 of the refrigerated pan opening 25 thereby providing enhanced cooling to the tops of the pans 24. Outlet vents 44 are provided in the bottom 46 of the refrigerated pan zone 22, and are in cold air communication with the cold food storage area 20. A main bottom vent 48 is located near the bottom of the cold food storage area 20 and is in cold air communication with an inlet 11 to the refrigeration unit 14. In a preferred embodiment, the refrigeration unit 14 has the capability of producing 3,480 BTU's an hour and two fans 15 are provided, one for each duct 32, 34, each of which are capable of moving air at the rate of 200 cubic feet per minute.

The operation of the food preparation table of the present invention is as follows. The refrigeration unit 14 is turned on and cold air is created and forced through the ducts 32, 34 by the fans 15. From the ducts 32, 34 the cold air is forced through the inlet vents 36 into the refrigerated pan zone 22 where it circulates around and cools the storage pans 24. From the refrigerated pan zone 22 the air is drawn through the outlet vents 44 into the cold food storage area 20. The air circulates through and cools the cold food storage area 20 and is drawn by the fans 15 back into the refrigeration unit 14 through the main bottom vent 48 where it is re-cooled and re-circulated. Thus as described above and in accordance with the present invention, the ingredients in the storage pans 24 and cold food storage area 20 are kept at a generally uniform desired temperature.

While the form of the apparatus herein described constitutes a preferred embodiment of the invention, it is to be understood that the invention is not limited to this precise form of apparatus, and that changes may be made therein without departing from the scope of the invention.

What is claimed is:

1. A food preparation table comprising:

a plurality of pans for storing food ingredients/condiments;

a cabinet defining a refrigerated pan zone, said cabinet being shaped to receive and suspend said pans such that a substantial portion of each of said pans is within said refrierated pan zone;

a refrigeration unit having at least one fan;

a run of ducts running along said refrigerated pan zone in cold air communication with said refrigeration unit; and a plurality of inlet vents located in said ducts providing cold air communication between said ducts and said refrigerated pan zone, wherein said inlet vents are positioned substantially near but underneath a top of said pans such that said inlet vents do not blow air over a top of said pans.

2. The food preparation table of claim 1 wherein said refrigerated pan zone includes four sides and a bottom and said ducts runs along two sides of said refrigerated pan zone.

3. The food preparation table of claim 2 wherein said inlets are positioned within said ducts not more than 1.5 inches from the top of said sides.

4. The food preparation table of claim 2 wherein said bottom of said refrigerated pan zone includes outlet vents.

5. The food preparation table of claim 4 wherein said outlet vents are positioned substantially equidistant from said inlet vents.

6. The food preparation table of claim 4 wherein said cabinet further defines a cold food storage area and said outlet vents are in cold air communication with said cold food storage area.

7. The food preparation table of claim 6 wherein said cold food storage area includes a main bottom vent in cold air communication with an inlet to said refrigeration unit.

8. The food preparation table of claim 1 wherein said cabinet further defines a work area.

9. The food preparation table of claim 8 wherein said work area is located on the top of said cabinet.

10. The food preparation table of claim 1 wherein said refrigerated pan zone is recessed in said cabinet.

11. The food preparation table of claim 1 wherein said cabinet includes ledges shaped to receive and engage corresponding edges on said pans such that a substantial portion of each of said pans is suspended in said refrigerated pan zone.

12. The food preparation table of claim 1 wherein said refrigeration unit is equipped with two fans, each of said fans capable of moving 200 cubic feet of refrigerated air per minute.

13. The food preparation table of claim 1 wherein said refrigeration unit is capable of producing over 3000 BTU's an hour.

14. The food preparation table of claim 1 wherein said refrigeration unit is capable of producing at least 3480 BTU's an hour.

15. A food preparation table comprising:

a plurality of pans for storing food ingredients/condiments;

a cabinet defining a refrigerated pan zone and a cold food storage area, said cabinet being shaped to receive and suspend said pans such that a substantial portion of each of said pans is within said refrigerated pan zone, wherein said cabinet has a top defining a work area and a recessed refrigerated pan opening;

a refrigeration unit having at two fans, wherein said fans are capable of moving 200 cubic feet of air per minute and said refrigeration unit is capable of producing at least 3000 BTU's an hour;

a pair of ducts, each of said ducts being in cold air communication with one of said fans, running along each side of said refrigerated pan zone in cold air communication with said refrigeration unit;

a plurality of inlet vents located in said ducts providing cold air communication between said ducts and said refrigerated pan zone, wherein said inlet vents are positioned not more than 1.5 inches from said refrigerated pan opening; and a plurality of outlet vents located in the bottom of said refrigerated pan zone providing cold air communication between said refrigerated pan zone and said cold food storage area.

16. A food preparation table comprising:

a plurality of pans for storing food ingredients/condiments;

a cabinet defining a refrigerated pan zone wherein said refrigerated pan zone includes four sides and a bottom having outlet vents positioned therein, said cabinet being shaped to receive and suspend said pans such that a substantial portion of each of said pans is within said refrierated pan zone;

a refrigeration unit having at least one fan;

a run of ducts running along said refrigerated pan zone in cold air communication with said refrigeration unit; and a plurality of inlet vents located in said ducts providing cold air communication between said ducts and said refrigerated pan zone, wherein said inlet vents are positioned substantially near but underneath a top of said pans.

17. The food preparation table of claim 16 wherein said outlet vents are positioned substantially equidistant from said inlet vents.

18. The food preparation table of claim 16 wherein said cabinet further defines a cold food storage area and said outlet vents are in cold air communication with said cold food storage area.

19. The food preparation table of claim 18 wherein said cold food storage area includes a main bottom vent in cold air communication with an inlet to said refrigeration unit.

20. The food preparation table of claim 16 wherein said cabinet further defines a work area.

21. The food preparation table of claim 16 wherein said refrigerated pan zone is recessed in said cabinet.

* * * * *

UNITED STATES PATENT AND TRADEMARK OFFICE

CERTIFICATE OF CORRECTION

PATENT NO. : 6,151,905
DATED : November 28, 2000
INVENTOR(S) : Al Smith

It is certified that error appears in the above-identified patent and that said Letters Patent is hereby corrected as shown below:

Claim 1, column 4,
Line 53, The word "refrierated" should be -- refrigerated --.

Claim 16, column 6,
Line 24, The word "refrierated" should be -- refrigerated --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*